United States Patent [19]

Gidewall et al.

[11] 4,142,453

[45] Mar. 6, 1979

[54] FLEXIBLE CONTAINER INSERTING APPARATUS

[75] Inventors: Kenneth L. Gidewall, Naperville; James Proce, Palatine, both of Ill.

[73] Assignee: CVP Systems, Inc., Lombard, Ill.

[21] Appl. No.: 848,475

[22] Filed: Nov. 4, 1977

[51] Int. Cl.[2] ..... B31B 7/02

[52] U.S. Cl. ..... 93/36.01; 53/175

[58] Field of Search ..... 93/36.01, 44.1 R, 44, 93/14-20; 53/175

[56] References Cited

U.S. PATENT DOCUMENTS 4,083,293 4/1978 Goldstein ..... 93/36.01

*Primary Examiner*—Roy Lake
*Assistant Examiner*—E. F. Desmond
*Attorney, Agent, or Firm*—Allegretti, Newitt, Witcoff & McAndrews

[57] ABSTRACT

An apparatus for inserting a flexible bag into a box having an open upper end. The apparatus includes a frame which supports the box with the upwardly directed open end. A vertically movable member is mounted on the frame above the box for receiving a flexible container thereon. The receiving member has a leading end and a trailing end. The flexible container, when it is received on the receiving member, includes a closed end which is coextensive with the leading end and an open end which is coextensive with the trailing end. The trailing end of the receiving member includes an operative mechanism for folding the open end of the flexible container down around the outer periphery of the open end of the outer container to preferably provide a substantially U-shaped or cuff-like fold. A mechanism is provided for moving the receiving member with the flexible container or bag thereon into the box until the leading end abuts the closed end of the inside of the box so that the flexible container is inserted into the outer container. The folding mechanism is constructed and arranged to continue moving after the leading end abuts the inside of the box so as to fold the open end of the flexible container, in the desired manner, around the outer periphery of the container.

8 Claims, 6 Drawing Figures

FLEXIBLE CONTAINER INSERTING APPARATUS

BACKGROUND OF THE INVENTION

Field of the Invention and Description of the Prior Art

This invention relates to an improved apparatus for inserting a flexible container or bag into a rigid outer container or box.

Flexible polyethylene container lined boxes or rigid containers are well known and have been widely used for many years for receiving a wide variety of materials, such as cheese, meat and various other perishable food products. Such flexible plastic containers may be manually inserted into the rigid container or box and then filled with the desired material. However, there are known devices wherein polyethylene flexible bags pass around a mandrel which is then moved into the flexible container so as to insert the bag therein. Since it is necessary to assure that the flexible container does not interfere with the filling of the flexible container after it is inserted into the box, the bag is manually folded in a suitable manner around the upper end of the box.

Manual folding of the open end of the bag around the open upper end of the box or rigid container into which the bag or flexible container is inserted slows production time. Also, when the bag is manually folded around the open upper end of the rigid container or box, the bag 15 generally manually folded straight downwardly so that the outer edge of the bag faces in a downward direction. This type of fold makes it more difficult for the bag, after filling, to be manually raised and placed inside the box for ultimate closing. It is, therefore, considered highly desirable to provide a bag inserting device which not only inserts the bag into the container but which also provides a convenient fold at the upper end thereof.

SUMMARY OF THE INVENTION

It is therefore an important object of this invention to provide an improved bag or flexible container inserting apparatus which includes a mechanism for folding the upper end of the bag around an open upper end of a box or rigid container into which the bag is inserted, substantially simultaneously with the insertion of the bag into the box.

It is also an object of this invention to provide an improved bag inserting apparatus which provides a cuff-like or U-shaped fold for the flexible container around the open upward end of the box into which the bag is inserted.

It is another object of the present invention to provide an improved bag inserting apparatus which provides for a higher production rate for bag insertions in a given time period as compared to the prior art bag inserting devices, wherein manual folding of the upper end of the flexible container or bag is required.

It is still another object of this invention to provide an improved bag inserting apparatus which not only inserts the bag but which provides a special cuff-like fold at the upper end of the bag.

It is also another object of this invention to provide an improved bag inserting apparatus which both inserts the bag and provides a convenient fold around the open upper end of the box into which it is inserted wherein the apparatus is particularly characterized by its simplicity and economy of construction and manufacture and efficiency in operation.

Further purposes and objects of this invention will appear as the specification proceeds.

The foregoing objects are accomplished by providing an apparatus for inserting a bag into a substantially rigid outer container or box having an open end, the apparatus including a frame for supporting the box, a member for receiving the flexible container therein, the receiving member having a leading end and trailing end, the bag or flexible container, when on the receiving means, having a closed end which is coextensive with the leading end of the receiving member and an open end which is coextensive with the trailing end thereof, a folding member operatively mounted on the receiving member for folding the open end of the flexible container around the outer periphery of the open end of the outer container, preferably with a cuff-like fold, a mechanism for moving the receiving and the folding members along with the flexible container member into the outer container or box until such time as the closed end of the bag abuts the bottom of the interior of the container, the folding member being constructed and arranged to continue moving relative to the receiving member so as to fold the open end of the flexible container around the outer periphery of the open end of the box after the leading end of the receiving member abuts the closed end of the box.

DETAILED DESCRIPTION OF THE PREFERRED EMBODIMENT

Figures 1, 2:
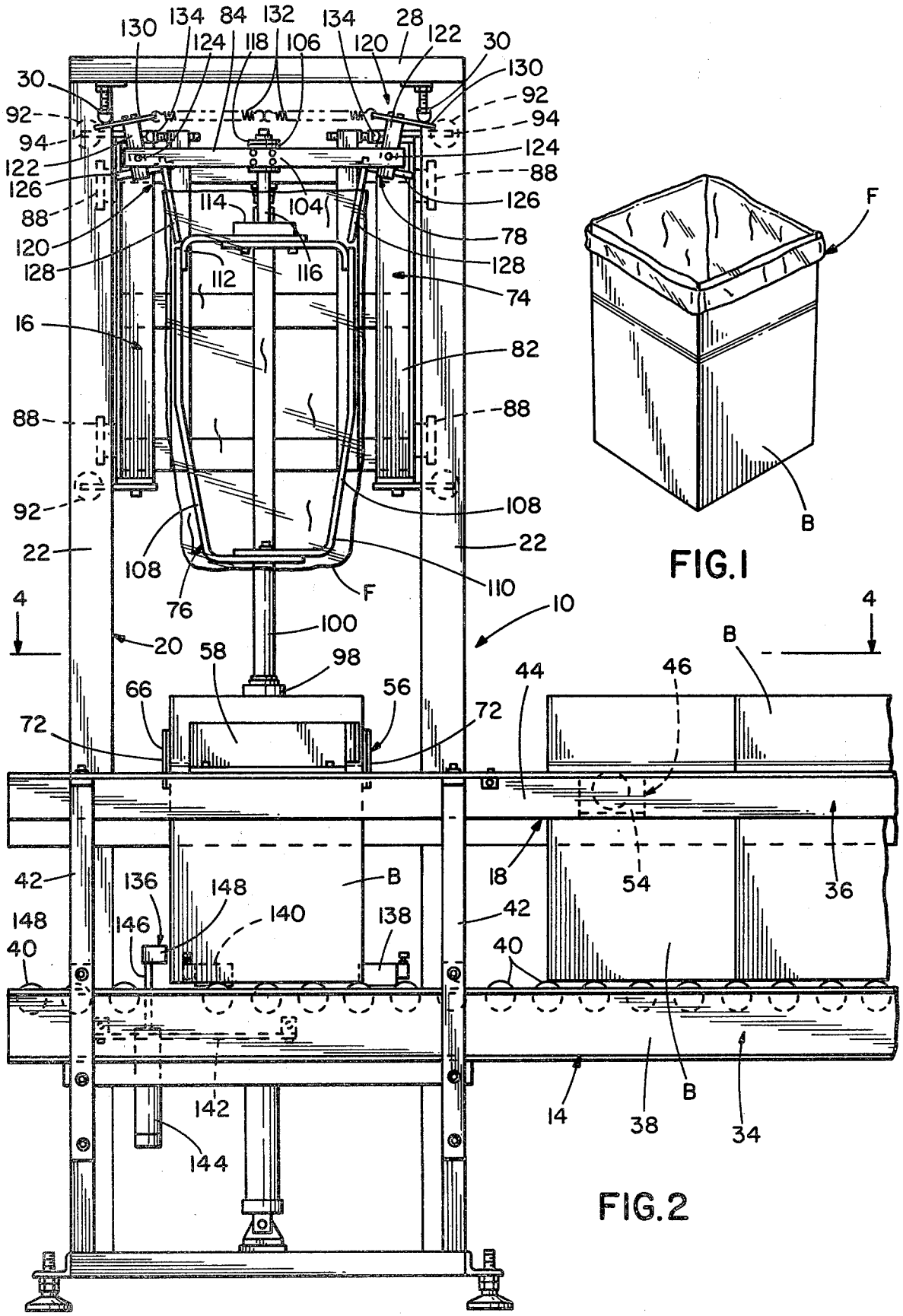
FIG. 1 is a pictorial view of a container with a flexible plastic container inserted therein and with the upper end thereof folded, the insertion and the folding of the bag being accomplished by our improved bag inserting apparatus.
FIG. 2 is a front elevational view of one preferred embodiment of our bag inserting apparatus.
Figure 3:
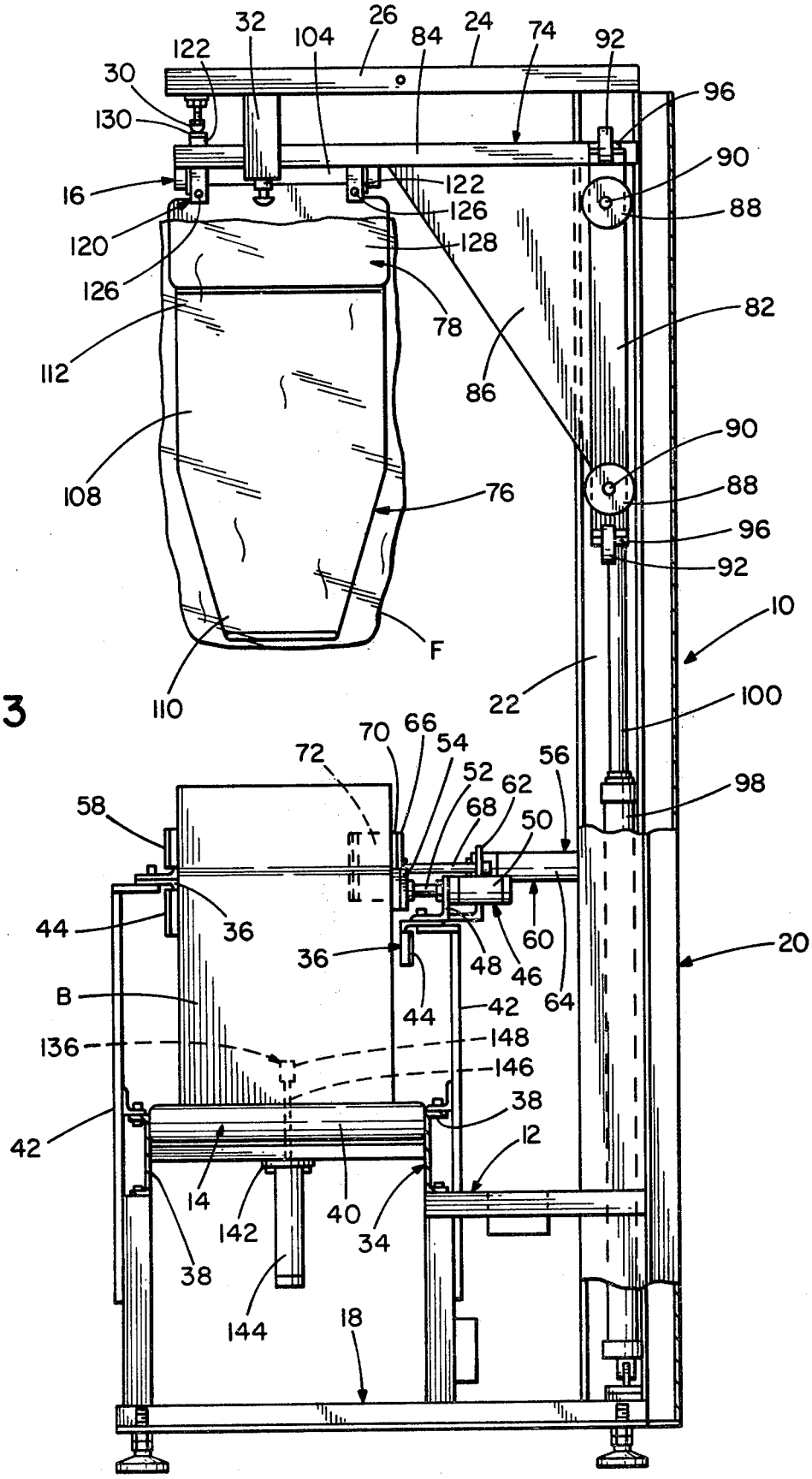
FIG. 3 is a side elevational view of the bag inserting apparatus of FIG. 2.

Referring particularly to FIGS. 2 and 3, the bag inserting apparatus, generally 10, includes a frame, generally 12, a conveyor mechanism, generally 14, operatively secured to the frame 12, the conveyor 14 moving and supporting a plurality of boxes or rigid containers B, and a vertically reciprocal mandrel assembly, generally 16, operatively mounted on the frame 12, the reciprocal mandrel assembly 16 being constructed and arranged to manually receive a flexible container or bag F thereon for insertion into the box B.

Figure 4:
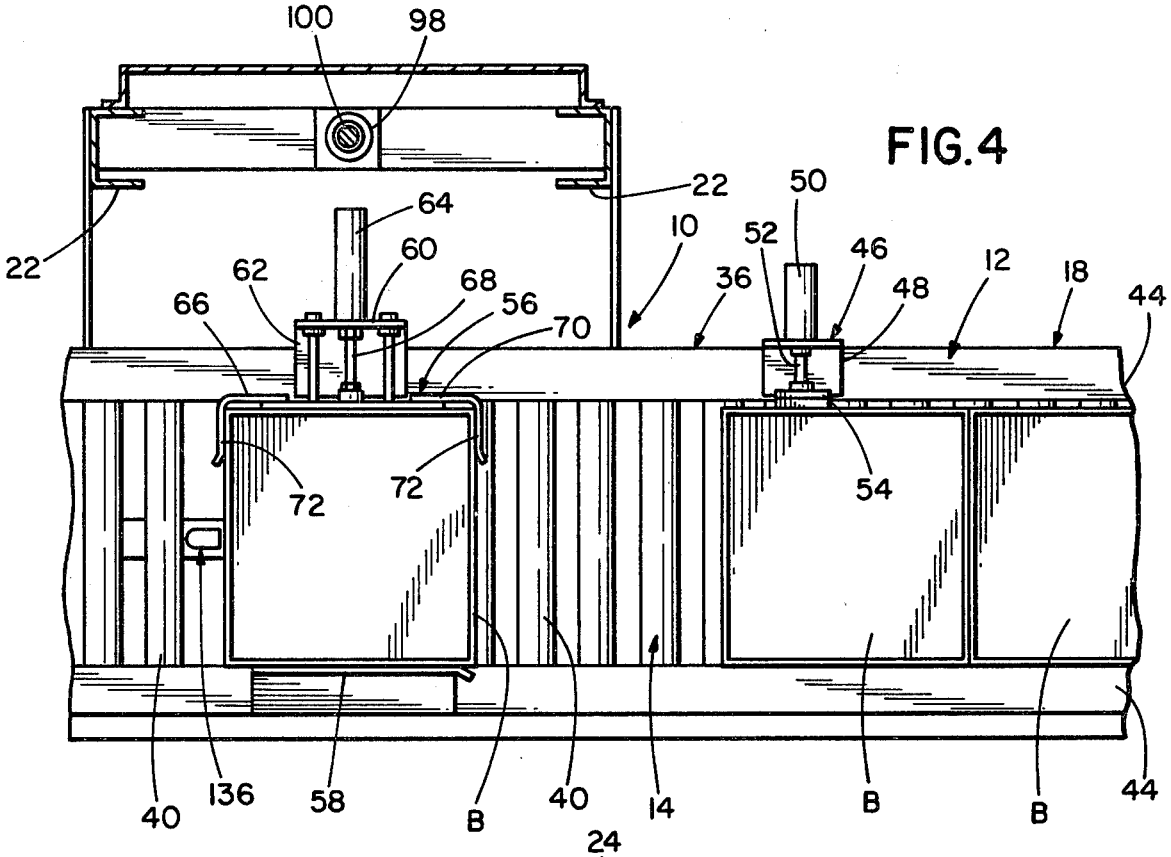
FIG. 4 is a sectional view taken along the line 4—4 of FIG. 2, illustrating the conveyor for feeding boxes to the bag inserting mechanism.

The frame 12, as best seen in FIGS. 2, 3 and 4 includes a generally horizontal frame section, generally 18, and a generally vertical frame section, generally 20, mounted at the outlet end of the horizontal frame section 18. The conveyor mechanism 14 is operatively mounted on the horizontal frame section 18 while the vertically reciprocal mandrel assembly 16 is operatively mounted on the vertical frame section 20.

As seen best in FIGS. 2 and 3, the vertical frame section 20 includes a pair of substantially vertical or upright rigid spaced supports 22 which are interconnected at the opposite upper ends thereof by a forwardly projecting overhead frame, generally 24. The overhead frame includes a pair of forwardly projecting horizontal supports 26 which are securely fixed to the upper ends of the laterally spaced upright supports 22. A pair of spaced transverse supports 28 are rigidly secured to the forward and rear ends of the forwardly projecting horizontal supports 26. A pair of laterally spaced, downwardly projecting adjustable stops are secured to the overhead frame 24, the purpose thereof to be hereinafter described in detail. As seen best in FIG. 3, an actuating switch 32 is secured to the overhead frame 24 and when activated begins a cycle for inserting the flexible container or bag F into the box B, as will be hereinafter described.

The conveyor mechanism 14 is generally horizontally mounted on the frame 12 and, as seen in FIGS. 2, 3 and 4, includes a lower conveyor frame, generally 34, and an upwardly spaced box guide frame, generally 36. The conveyor frame 34 includes a pair of longitudinal, spaced support channels 38. The channels 38 operatively carry a plurality of spaced rollers 40. The conveyor rollers support boxes B as they are moved thereon for bag insertion. As will be described, the conveyor rollers 40 are operated in a known manner so as to move the boxes B in a row, as seen best in FIG. 2, to the area directly below the mandrel assembly 16 for insertion of the flexible container F thereinto.

The box guide frame 36 is supported in a vertically spaced relationship above the conveyor frame 34. The box guide frame 36 is secured in place by a plurality of spaced upright supports 42 which are positioned along the length of the guide frame 36 and the conveyor frame 34. The box guide frame 36 includes a pair of spaced, horizontal guide plates 44. As seen best in FIG. 3, the guide plates 44 are spaced laterally apart so that a plurality of boxes B may be guided as they are moved on the conveyor 14 in a substantially aligned relationship.

In moving the boxes B along the conveyor 14 in a substantially aligned relationship, a stop ram assembly, generally 46, is mounted along the rear of the guide plates 44 and is mounted for engaging the second of a series of aligned boxes B moving along the conveyor 14. The ram assembly 46 generally comprises a support member 48 which is securely mounted on the rear of the guide plates 44. A frontwardly projecting air cylinder 50 is mounted on the support mechanism 48 and includes a frontwardly projecting piston rod 52 having a transverse cushioned plate 54 at the forward end thereof. As will be described, the ram assembly 46 holds a box B and all trailing boxes being moved on the conveyor 14 while one flexible container F is being inserted into a box B by the mandrel assembly 16.

A box flap holder assembly, generally 56, is operatively mounted on the front and rear guide plates 44, below the mandrel assembly 16. The flap holder assembly 56 includes a rigid longitudinal plate 58 which is fixedly secured to the front guide plate 44 and preferably includes cushioned inner face for bearing against the front flap of the box B. The holder assembly 56 also includes a ram assembly, generally 60, as seen best in FIG. 4. The ram assembly includes a support member 62 which is fixedly mounted to the rear guide plate 44. An air cylinder 64 is fixedly secured to the support member in a forwardly directed position. A U-shaped flap holder 66 is fixedly secured to the outer end of the piston rod 68 of the air cylinder 64. The U-shaped holder 66 includes a rear section 70 and a pair of unitary spaced forwardly projecting arms 72. The rear plate 70 is constructed and arranged to bear against the rear flap of the box B while the two spaced side arms 72 are constructed and arranged to engage the outer surfaces of the side flaps of the box B. The box flap holder assembly 56, as seen, holds a box B and the flaps thereof, below the mandrel assembly 16, in a temporarily secured position during the insertion of the flexible container or bag F thereinto.

Referring to FIGS. 2, 3, 5 and 6, the mandrel assembly 16, generally includes a vertically reciprocal carriage assembly, generally 74, a fixed bag receiving mandrel, generally 76, which is mounted on the carriage 74, and a bag folding assembly, generally 78, which is operatively mounted on the carriage 74 in a position immediately above the fixed mandrel 76.

The carriage assembly 74, as seen best in FIG. 3, generally includes a rear upright frame 82 and an overhead frame 84, the rear end of the overhead frame 84 being rigidly secured to the upper end of the rear frame 82. A pair of rigid corner plates 86 rigidly secure the rear frame 82 and overhead frame 84 together in a substantially right angle relationship. The carriage assembly 78 includes a pair of vertically spaced guide wheels 88 which are rotatably mounted on each of the opposite sides of the rear upright frame 82. The wheels 88 are rotatable about horizontal, sidewardly facing axes 90. Each pair of the vertically spaced wheels 88 rollably engages each of the upright supports 22 which also define guide tracks for the wheels 88. Referring to FIGS. 2 and 3, two additional pair of guide wheels 92 are rigidly mounted on a pair of vertically spaced support arms 94 which are rigidly secured to both the upper and lower ends of the opposite sides of the rear upright frame 82 of the carriage assembly 74. The wheels 92 are rotatably mounted about horizontal, forwardly projecting axes 96. As best seen in FIGS. 2 and 3, the guide wheels 92 are constructed and arranged to bear against the inner surfaces of the opposite sides of each of the upright supports 22, each of which has a channel shaped cross section. The wheels 88 and 92, vertically guide the mandrel assembly 16 for upward and downward directions for insertion of a flexible container F into the box B and for removal of the mandrel assembly therefrom after bag insertion.

A vertically elongated air operated cylinder 98 is mounted at its lower end to the frame 12 and at its upper end to the central portion of the carriage assembly 74. The cylinder 98 includes a piston rod 100 which is reciprocally mounted in a vertical direction within the cylinder 98 and is rigidly secured to the carriage assembly 74. Operation of the air operated drive cylinder 98 raises and lowers the carriage assembly 74 and thereby the fixed mandrel 76 and folding mechanism 78 in downward and upward directions for each bag insertion cycle.

A substantially horizontal overhead support frame, generally 104, supports both the fixed mandrel assembly 76 and the folding mechanism 78. A vertical guide bearing 106 is mounted in the overhead support frame 104.

The fixed mandrel assembly 76 includes a pair of generally vertically elongated, formed plate members 108 which are adjustably mounted together. The mandrel plates 108 define a bottom or leading end 110 and a top or trailing end 112. The upper or trailing end 112 of the mandrel plates 108 has a support block 114 mounted thereon. The support block 114 is rigidly secured to the lower end of a vertical guide rod 116. The vertical guide rod 116 is slidably received within the bearing member 106 mounted on the overhead mandrel support assembly 104. The upper end of the guide rod 116 includes a collar 118 which is rigidly secured thereto and which, in the mandrel raised position, rests against the upper face of the guide bearing 106. It is seen that this arrangement provides for a floating interconnection between the fixed mandrel assembly 76 and the overhead mandrel support assembly 104, so that the folding assembly 78 may move relative to the fixed mandrel assembly 76.

The folding assembly 78 includes opposed spaced folder assemblies, generally 120, which are mirror images of each other and are wider than the fixed mandrel plates 108. Each folder assembly 120 includes a support member 122 which is pivotally mounted on a horizontal, forwardly facing axis 124, each of which is fixed to the outer end of the overhead mandrel support 104. A lower, substantially transverse arm 126 is secured to each support 122. The inner end of each arm 126 includes a rigid, substantially downwardly extending folder plate 128 which is wider than the fixed mandrel plate 108. An upper transverse arm 130 is secured to each support 122 and extends transversely therefrom. The outside end of the upper arm 130 is constructed and arranged to be in alignment with the adjustable stop 30 located on the overhead frame 24. The opposite end of the upper arm 130 is interconnected to a tension spring 132. Each of the tension springs 132 is connected to the other to normally cause each folding assembly 120 to pivot about the axis 124 in a direction so that each folder plate 128 pivots outwardly and away from the other. As seen best in FIGS. 5 and 6, an adjustable, outwardly facing stop 134 is provided at the opposite sides of the overhead mandrel support 104, so that the outward pivoting of the folder assemblies 120 by the springs 132 is limited so that the folder arms 126 are normally moved to a substantially upright position for the folding operation.

In positioning the box B below the fixed mandrel assembly 76 and below the folding assembly 78 for inserting the container F therein and for folding the upper end of the bag or container F around the outside of the box B, there is provided a stop arm assembly, generally 136, which is mounted on the conveyor frame 34. Also, limit switches 139 and 140 are provided for appropriate sequencing of each bag insertion cycle. The stop arm assembly 136 includes a mounting plate 142 which is rigidly secured to the conveyor frame 34. An upwardly directed air operated cylinder 144 is mounted on the plate 142. The cylinder 144 includes an upwardly projecting piston rod 146 which projects upwardly between the rollers. The rod 146 terminates in a stop member 148 which is positioned so as to engage the leading end of the box B for positioning the box B below the mandrel assembly 16.

It is believed that a description of the operation of the apparatus 10, as described above, will provide for a more full understanding of the invention. Referring to FIG. 2, a plurality of boxes B, in the open position, with flaps on the outer, upper end thereof, are moved along the conveyor mechanism 14 to the area below the mandrel assembly 16. As a box B initially engages the limit switch 138, the air cylinder 50 is activated to drive the piston rod 52 forwardly until the cushion plate 54 engages the rear surface of the box which trails the leading box B which is moving towards the area below the mandrel section 16. The cushioned plate 54 moves the box B against the front guide plate 44 so as to hold the leading box and all the trailing boxes from the bag inserting area below the mandrel assembly 16, even though the conveyor 14 is in constant motion.

As the leading box B moves forward along the conveyor frame 34, the edge of the box B activates the limit switch 140. This activates the cylinder 144 to move the stop 148 upwardly and stop forward movement of the box B.

Referring to FIGS. 2 and 3, the operator then passes a flexible container or bag F upwardly on the fixed mandrel 76 so the open end of the bag F passes the leading end 110 of the fixed mandrel section 176. The operator lifts the bag F upwardly until the bottom of the bag abuts the leading or lower end 110 of the mandrel 76. At this time, the upper end of the flexible bag F is positioned co-extensively with the folding assembly 78. The operator then manually strikes the switch 32 to activate the drive cylinder 98 to move the carriage assembly 74 downwardly with the bag F in place on the fixed mandrel 76 with the open end thereof being adjacent the folding assembly 78. The air cylinder 64 is also activated to drive the ram assembly 60 forwardly so that the U-shaped holder 66 engages the side flaps of the box B and the rear flap of the box B. The U-shaped holder 66 also caves the box B and the rear flap of the box B and thereby the front flap to bear against the longitudinal plate 48 on the front side. The box holder assembly thereby secures all four flaps and the box B in a temporarily secured position below the mandrel.

Figure 6:
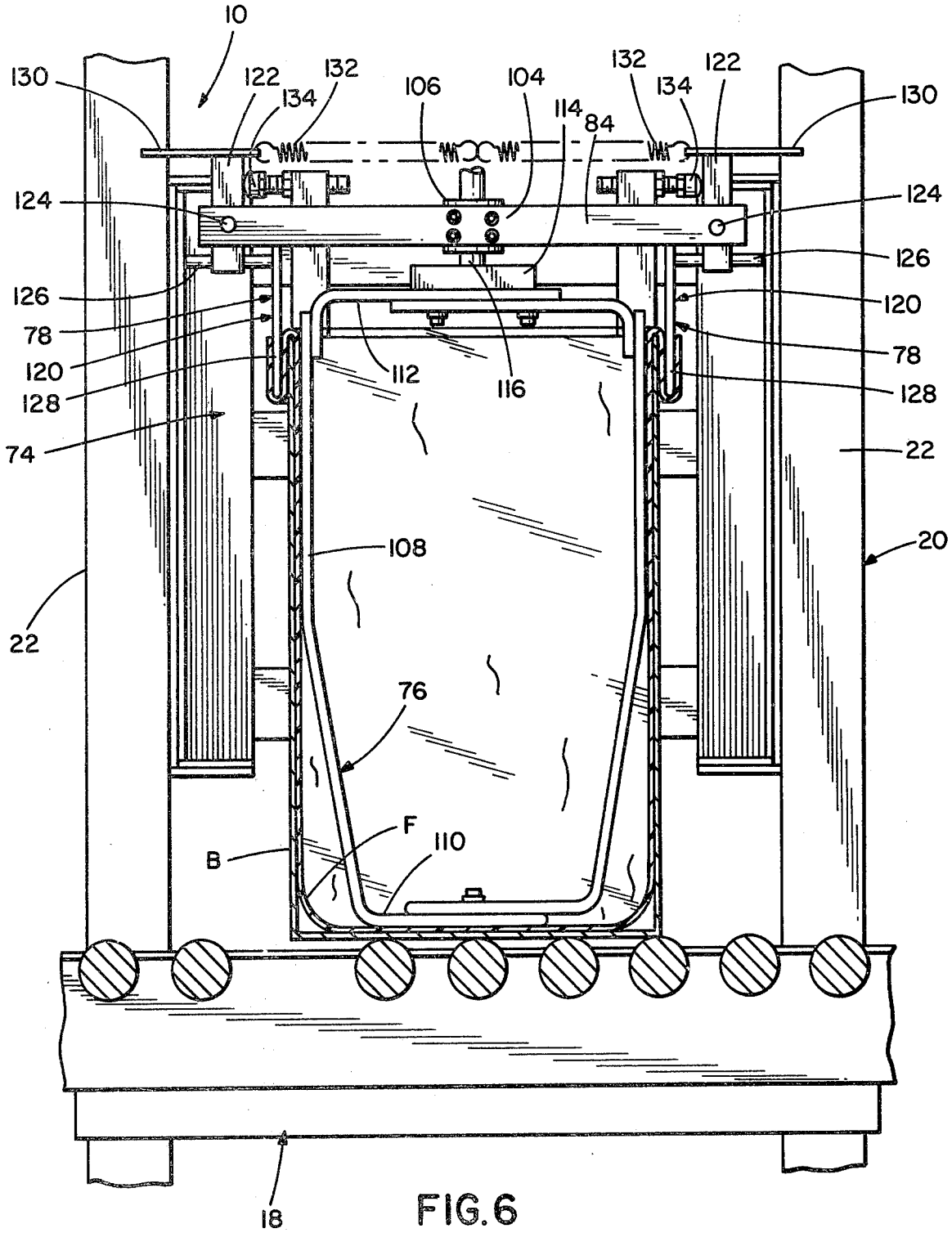
FIG. 6 is a partially sectioned view of the bag receiving apparatus and folding mechanism, with the bag inserted into the container and with the fold being formed at the upper end of the flexible container around the open end of the rigid box or container.

Referring to FIG. 6, the cylinder 98 moves the carriage 74, with the folding assembly 78, and the fixed mandrel assembly 76 downwardly until the fixed mandrel 76 stops its downward movement when the leading or lower end 110 and the bottom of the bag meet the inside surface of the box B. The carriage 74 and the folding assembly 78 move downwardly until the fixed mandrel 76 stops its downward movement when the leading or lower end 110 thereof and the bottom of the bag meet the inside surface of the box B. The carriage 74 and the folding assembly 78 continue the downward movement because of the floating connection between the fixed mandrel 76 and the carriage 74.

Figure 5:
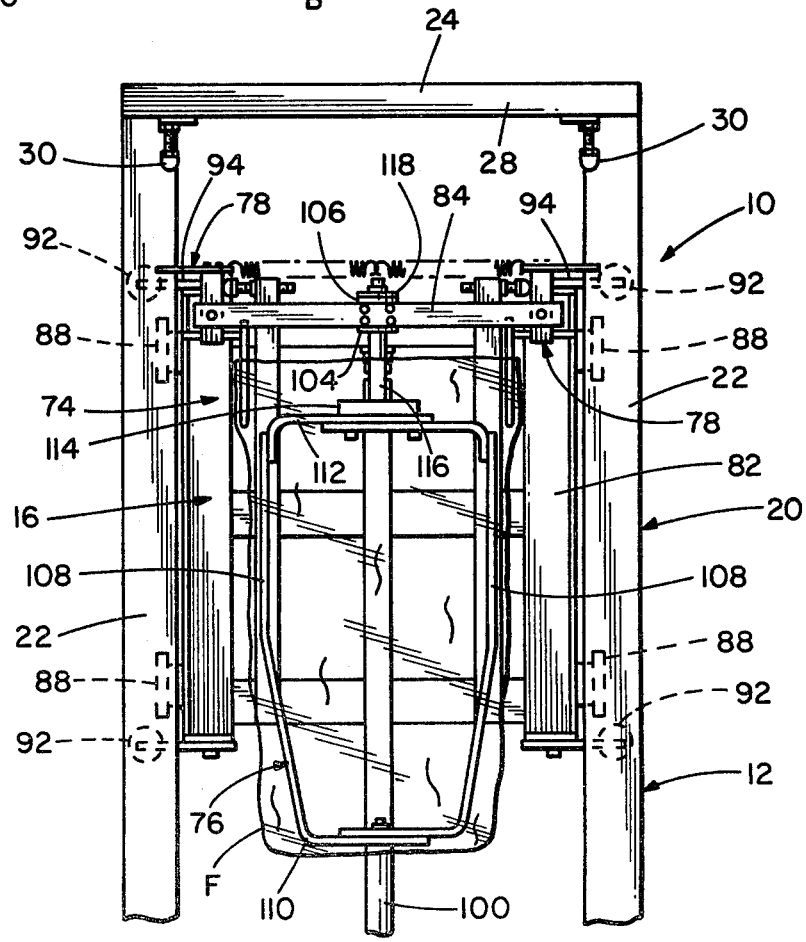
FIG. 5 is a fragmentary view illustrating the bag receiving member and the folding mechanism as they are being moved toward the box into which the bag is being inserted.

Referring to FIGS. 2 and 5, it is seen that as soon as the carriage assembly 74 commences its downward movement, the springs 132 pivot the folding plates 128 outwardly about their pivot axes 124. As seen in FIGS. 2 and 5, when in the fully raised position, the folding arms are pivoted inwardly because the fixed stops 30 pivot the folder assemblies 120 inwardly toward each other to facilitate the placement of the bag F on the assembly. However, in the downward movement, the folding arms 126 move outwardly so that the surfaces of the folder arms 126 extend laterally outwardly beyond the outer surface of the mandrel plates 108. When this occurs, the open end of the flexible bag F is moved or stretched outwardly, in all directions, slightly beyond the entire outer periphery of the box B.

Referring again to FIG. 6, with the bag moved or stretched in this manner, it is seen that the folder plates, with the bags stretched therearound, pass outwardly of the outer surfaces of the box B. With the folder assembly continuing downward movement with the carriage 74, the folding assembly 120 moves to the position shown in FIG. 6. The folders 120 provide a U-shaped or a cuff-like fold on the upper open end of the flexible bag around the open end of the box. At this point the insertion is complete and the cylinder 98 automatically reverses and raises the carriage assembly 74, the folding assembly 120 and the mandrel 76 upwardly, leaving the flexible bag on the box B and folded around the outside of the box with a cuff-like fold, as seen in FIG. 1. The cuff-like fold provides a convenient way for the operator, after filling of the bag, to raise the bag and cause the bag to be easily sealed or enclosed, in a suitable manner, within the box. As the carriage is moving upwardly, the stop 148 moves down and the ram 60 moves back and the box B with the bag therein moves forwardly. Also, the ram assembly 146 reverses and the next box is permitted to move forwardly for another bag insertion cycle.

While in the foregoing there has been provided a detailed description of a particular embodiment of the present invention, it is to be understood that all equivalents obvious to those having skill in the art are to be included within the scope of the invention, as claimed.

What is claimed is:

1. Apparatus for inserting a flexible container into a substantially rigid outer container having an open end, said apparatus comprising, in combination, a frame, means on said frame for supporting said outer container, means on said frame for receiving said flexible container thereon, said receiving means being aligned with said outer container, said receiving means having a leading end and a trailing end, said flexible container, when on said receiving means, having a closed end coextensive with said leading end and an open end coextensive with said trailing end, means operatively mounted on said receiving means at said trailing end for folding said open end of said flexible container around the outer periphery of said open end of said outer container, and means on said frame for moving said receiving means with said flexible container thereon into said outer container until said leading end abuts the closed end of said outer container, with said flexible container being inserted into said outer container, said folding means being constructed and arranged to continue moving relative to said receiving means for folding said open end of said flexible container around said periphery of said open end of said outer container.

2. The apparatus of claim 1 including a conveyor for moving a plurality of said outer containers along a path of travel to an aligned position below said receiving means.

3. The apparatus of claim 2 wherein said conveyor is horizontally mounted on said supporting means and wherein said apparatus includes a substantially vertical frame for said receiving means and for said folding means, said vertical frame being supported at one end of said horizontal supporting means.

4. The apparatus of claim 1 including a reciprocally movable carriage for supporting and carrying both said receiving means and said folding means, and a floating interconnection is provided between said receiving means and said folding means for permitting said continued movement of said folding means relative to said receiving means.

5. The apparatus of claim 1 wherein said folding means includes means for providing a cuff-like fold on said flexible container around said rigid container.

6. The apparatus of claim 1 wherein said folding means is movable between a flexible container receiving position and a flexible container folding position.

7. The apparatus of claim 1 including a vertically movable carriage for said receiving means and said folding means, and means for guiding said carriage on said frame in vertical upward and downward directions, and wherein said moving means comprises drive cylinder means.

8. The apparatus of claim 1 including means for conveying a plurality of aligned rigid containers to a position below said receiving means, means for stopping the second in a line of said rigid containers while the first of said rigid containers continues movement to a position below the flexible container receiving position, means for stopping movement of said first rigid container for positioning said container below said receiving means, and means for temporarily securing said first rigid container below said receiving means while said flexible container is being inserted into said outer container.

* * * * *